US010069261B2

(12) United States Patent
Sakurada

(10) Patent No.: US 10,069,261 B2
(45) Date of Patent: Sep. 4, 2018

(54) BUSBAR TERMINAL, BUSBAR TERMINAL CONNECTION STRUCTURE, AND BUSBAR TERMINAL CONNECTION METHOD

(71) Applicant: HONDA MOTOR CO., LTD., Tokyo (JP)

(72) Inventor: Manabu Sakurada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/371,098

(22) Filed: Dec. 6, 2016

(65) Prior Publication Data

US 2017/0222377 A1 Aug. 3, 2017

(30) Foreign Application Priority Data

Feb. 1, 2016 (JP) ..... 2016-017037

(51) Int. Cl.

| | |
|---|---|
| ***H01R 4/34*** | (2006.01) |
| ***H01R 11/12*** | (2006.01) |
| ***H01R 13/512*** | (2006.01) |
| ***H01R 25/16*** | (2006.01) |
| ***H01R 4/18*** | (2006.01) |
| ***H01R 43/048*** | (2006.01) |

(52) U.S. Cl.
CPC ..... *H01R 25/162* (2013.01); *H01R 4/183* (2013.01); *H01R 43/048* (2013.01)

(58) Field of Classification Search
CPC ..... H01R 4/34; H01R 11/12; H01R 13/512; H01R 2201/26; H01R 11/01; H01R 11/05; H01R 11/11; H01R 11/28; H01R 35/00; H01R 43/048; H01R 4/12; H01R 4/18; H01R 4/183; H01R 4/184; H01R 4/185
USPC ..... 439/883, 271, 709, 76.2, 777, 845, 884, 439/949
See application file for complete search history.

(56) References Cited

U.S. PATENT DOCUMENTS

| | | | | |
|---|---|---|---|---|
| 4,679,888 A * | 7/1987 | Williams | ..... | H01R 4/302 439/801 |
| 7,137,833 B2 * | 11/2006 | Woodward | ..... | H01R 43/16 439/115 |
| 7,780,488 B2 * | 8/2010 | Robertson | ..... | H01R 11/12 439/777 |

(Continued)

FOREIGN PATENT DOCUMENTS

| | | |
|---|---|---|
| JP | 3909680 B2 | 11/2003 |
| JP | 2013-232371 | 11/2013 |

(Continued)

OTHER PUBLICATIONS

Japanese Office Action for corresponding JP Application No. 2016-017037, dated Sep. 26, 2017 (w/ English machine translation).

*Primary Examiner* — Michael A Lyons
*Assistant Examiner* — Matthew T Dzierzynski
(74) *Attorney, Agent, or Firm* — Mori & Ward, LLP

(57) ABSTRACT

A busbar terminal includes a fastening portion, a crimping portion, and a torsion portion. The fastening portion is electrically connected to a terminal base. The crimping portion is electrically connected to a conducting wire. The torsion portion electrically connects the fastening portion and the crimping portion. The torsion portion includes a twisted part between the fastening portion and the crimping portion.

20 Claims, 10 Drawing Sheets

(56) References Cited

U.S. PATENT DOCUMENTS

| | | | | |
|---|---|---|---|---|
| 7,802,998 | B2 * | 9/2010 | Taguchi | H01R 4/305 439/76.2 |
| 7,955,101 | B2 * | 6/2011 | Lawson | H01R 11/12 439/177 |
| 8,993,890 | B2 * | 3/2015 | Sato | H01R 4/184 174/113 R |
| 9,184,524 | B2 * | 11/2015 | Tomita | H01F 7/06 |
| 9,343,941 | B2 * | 5/2016 | Okamoto | H01R 13/5202 |
| 9,391,485 | B2 * | 7/2016 | Kobayashi | H01R 9/24 |
| 9,419,491 | B2 * | 8/2016 | Egami | H02K 3/50 |
| 9,472,893 | B1 * | 10/2016 | Motohashi | H01R 13/533 |
| 2009/0108688 | A1 * | 4/2009 | Miura | B60L 3/0061 310/71 |
| 2015/0280509 | A1 * | 10/2015 | Shi | H02K 3/38 310/71 |

FOREIGN PATENT DOCUMENTS

| | | |
|---|---|---|
| JP | 2014-232601 | 12/2014 |
| JP | 2015-11873 | 1/2015 |
| JP | 2015-177700 | 10/2015 |

* cited by examiner

BUSBAR TERMINAL, BUSBAR TERMINAL CONNECTION STRUCTURE, AND BUSBAR TERMINAL CONNECTION METHOD

CROSS-REFERENCE TO RELATED APPLICATIONS

The present application claims priority under 35 U.S.C. § 119 to Japanese Patent Application No. 2016-017037, filed Feb. 1, 2016, entitled "Busbar Terminal, Busbar Terminal Connection Structure, and Busbar Terminal Connection Method." The contents of this application are incorporated herein by reference in their entirety.

BACKGROUND

Technical Field

The present disclosure relates to a busbar terminal, a busbar terminal connection structure, and a busbar terminal connection method.

Discussion of the Background

Recent vehicles include an alternating-current motor for use as an actuating mechanism. The alternating-current motor is connected to a battery with a power control unit (hereinafter referred to as a PCU) interposed therebetween. The PCU controls actuation and/or regeneration of the alternating-current motor. The PCU houses components including an electric circuit inside its casing and has a terminal base attached to the outer side of the casing. An end portion of a conducting wire of the alternating-current motor is connected to the terminal base with a busbar terminal (or simply referred to as a busbar) interposed therebetween.

Japanese Patent No. 3909680 (paragraphs [0010] and and FIG. 1) discloses a connector structure applicable in, for example, an electric vehicle. This connector structure includes a busbar having a substantially L-shaped section obtained by bending a flat busbar member at substantially 90°. The busbar connects an end portion of a cable (conducting wire) of a motor to an end portion of a conducting wire of a power supply, such as a PCU. Japanese Patent No. 3909680 (paragraphs [0010] and [0011] and FIG. 1) describes that the conducting wire of the power supply is rendered movable with respect to the busbar to allow for certain precision errors between components.

SUMMARY

According to a first aspect of the present invention, a busbar terminal that electrically connects a terminal base and a conducting wire to each other, the busbar terminal includes a fastening portion, a crimping portion, and a torsion portion. The fastening portion is fastened to the terminal base. The crimping portion is connected to the conducting wire. The torsion portion is interposed between the fastening portion and the crimping portion and extends from the fastening portion to the crimping portion while being twisted.

According to a second aspect of the present invention, a busbar terminal includes a fastening portion, a crimping portion, and a torsion portion. The fastening portion is electrically connected to a terminal base. The crimping portion is electrically connected to a conducting wire. The torsion portion electrically connects the fastening portion and the crimping portion. The torsion portion includes a twisted part between the fastening portion and the crimping portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
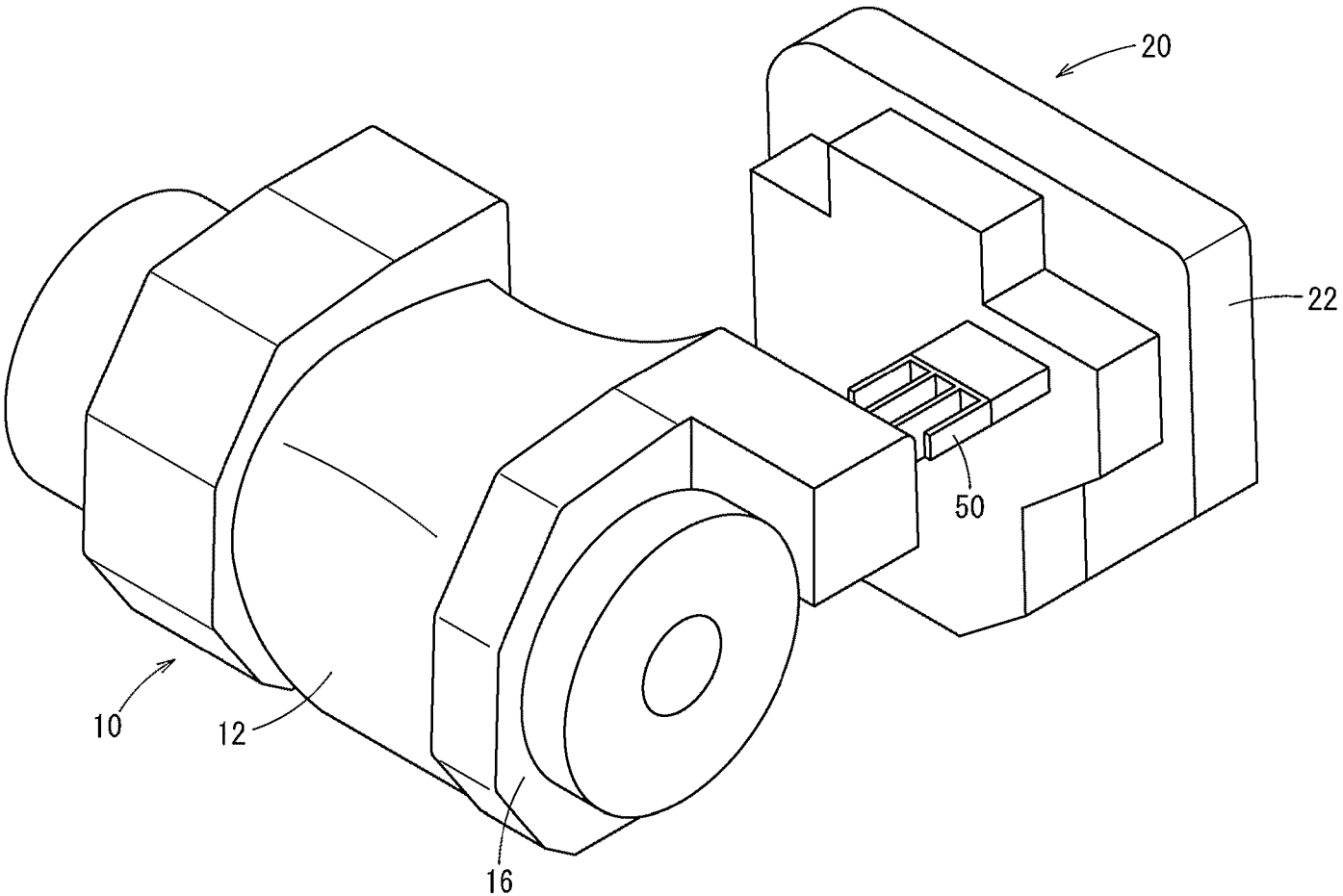
FIG. 1 is an external view of an alternating-current motor and a PCU.

The embodiments will now be described with reference to the accompanying drawings, wherein like reference numerals designate corresponding or identical elements throughout the various drawings.

Referring now to the drawings, a busbar terminal, a busbar terminal connection structure, and a busbar terminal connection method according to embodiments are described in detail. Components are schematically drawn throughout the drawings. This description assumes, as electrical devices electrically connected to each other by the busbar terminal, a three-phase alternating-current motor used as an actuator for an electric vehicle, a hybrid car, or a fuel-cell vehicle, and a PCU that controls actuation and/or regeneration of the alternating-current motor.

1. Arrangement 1 of Alternating-Current Motor 10 and PCU 20

Referring now to FIG. 1, an example of an arrangement of an alternating-current motor 10 and a PCU 20 is described. The alternating-current motor 10 is disposed around a drive shaft (not illustrated), for example, coaxially with a drive shaft. The PCU 20 is disposed around the alternating-current motor 10. In an embodiment illustrated in FIG. 1, the PCU 20 is disposed to a vehicle front side of the alternating-current motor 10. A power source (not illustrated), such as a battery or a fuel cell stack, is electrically connected to the PCU 20.

The alternating-current motor 10 includes a housing 12, and a stator 14 (see FIG. 2) and a rotor (not illustrated), disposed in the housing 12. A lid 16 is attached to the housing 12. The PCU 20 includes a casing 22, and, a DC/DC converter, an inverter, and a motor electrical control unit (ECU), which are not illustrated and are disposed inside the casing 22. The DC-to-DC converter converts direct current fed from a power source from one voltage level to another. The inverter converts direct current into alternating current for motor control. The motor ECU controls the alternating-current motor 10. A terminal base 50 including terminals of an electric circuit is attached to a portion outside the casing 22 and disposed to the vehicle rear side. The terminal base 50 is inserted into a hole (not illustrated) formed in the lid 16 and disposed inside the alternating-current motor 10. The hole formed in the lid 16 and the periphery of the hole are sealed as a result of the terminal base 50 being inserted into the alternating-current motor 10.

Figure 2:
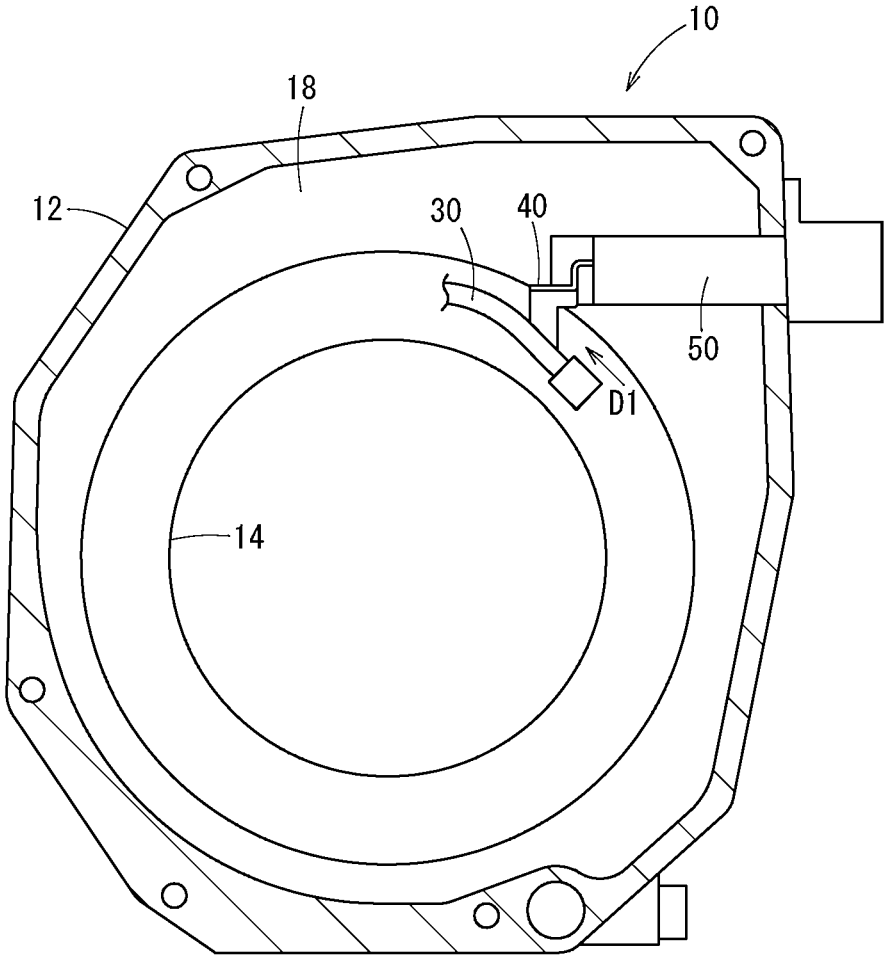
FIG. 2 illustrates an arrangement of a conducting wire and a terminal base.

Referring now to FIG. 2, an arrangement of conducting wires 30 of the alternating-current motor 10 and the terminal base 50 of the PCU 20 is described. FIG. 2 illustrates the alternating-current motor 10 viewed in an axial direction and from which the lid 16 (see FIG. 1) is removed. In FIG. 2, a vertical direction in the drawing coincides with the vertical direction of the vehicle, a rightward direction in the drawing coincides with a frontward direction of the vehicle, and a leftward direction in the drawing coincides with a rearward direction of the vehicle. FIG. 2 illustrates only portions required for describing embodiments and does not illustrate portions publicly known (such as a rotor). Some of components (stator 14) are schematically shown.

A stator support portion 18 is disposed in the housing 12 around the outer circumference of the stator 14. The stator support portion 18 supports the outer circumferential surface of the stator 14. As publicly known, the stator 14 includes three (U-phase, V-phase, and W-phase) conducting wires 30 coiled around an iron core. Each conducting wire 30 is covered with an insulating member. A lead portion extending from the coil of each conducting wire 30 is wound around a shaft of the alternating-current motor 10 at one end of the stator 14 (front end in FIG. 2). In FIG. 2, the lead portion of each conducting wire 30 is wound and extends in a clockwise direction. On the other hand, the terminal base 50 extends to the vehicle rear (leftward in FIG. 2). The conducting wire 30 and the terminal base 50 are connected to each other with a busbar terminal 40 interposed therebetween.

2. Busbar Terminal 40

Figure 3:
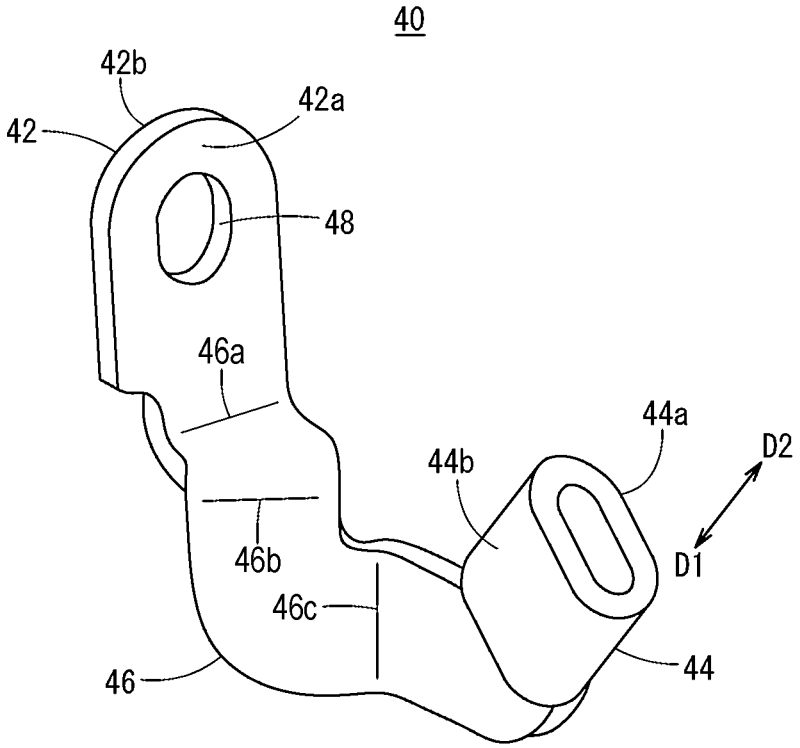
FIG. 3 is an external view of a busbar terminal according to an embodiment.
Figure 4:
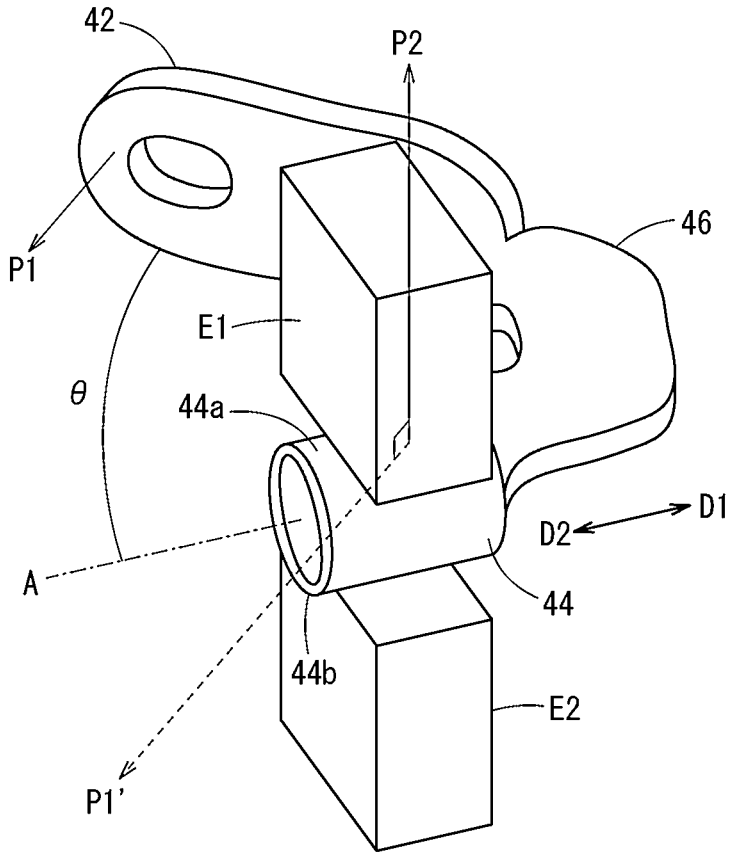
FIG. 4 illustrates a crimping direction of a crimping portion of the busbar terminal.

Referring now to FIG. 3 and FIG. 4, the busbar terminal 40 is described. The busbar terminal 40 is formed of a flat metal member having a predetermined shape obtained by being punched out by a press. The busbar terminal 40 includes a fastening portion 42 at a first end portion, a crimping portion 44 at a second end portion, and a torsion portion 46, disposed between the fastening portion 42 and the crimping portion 44.

Figure 5:
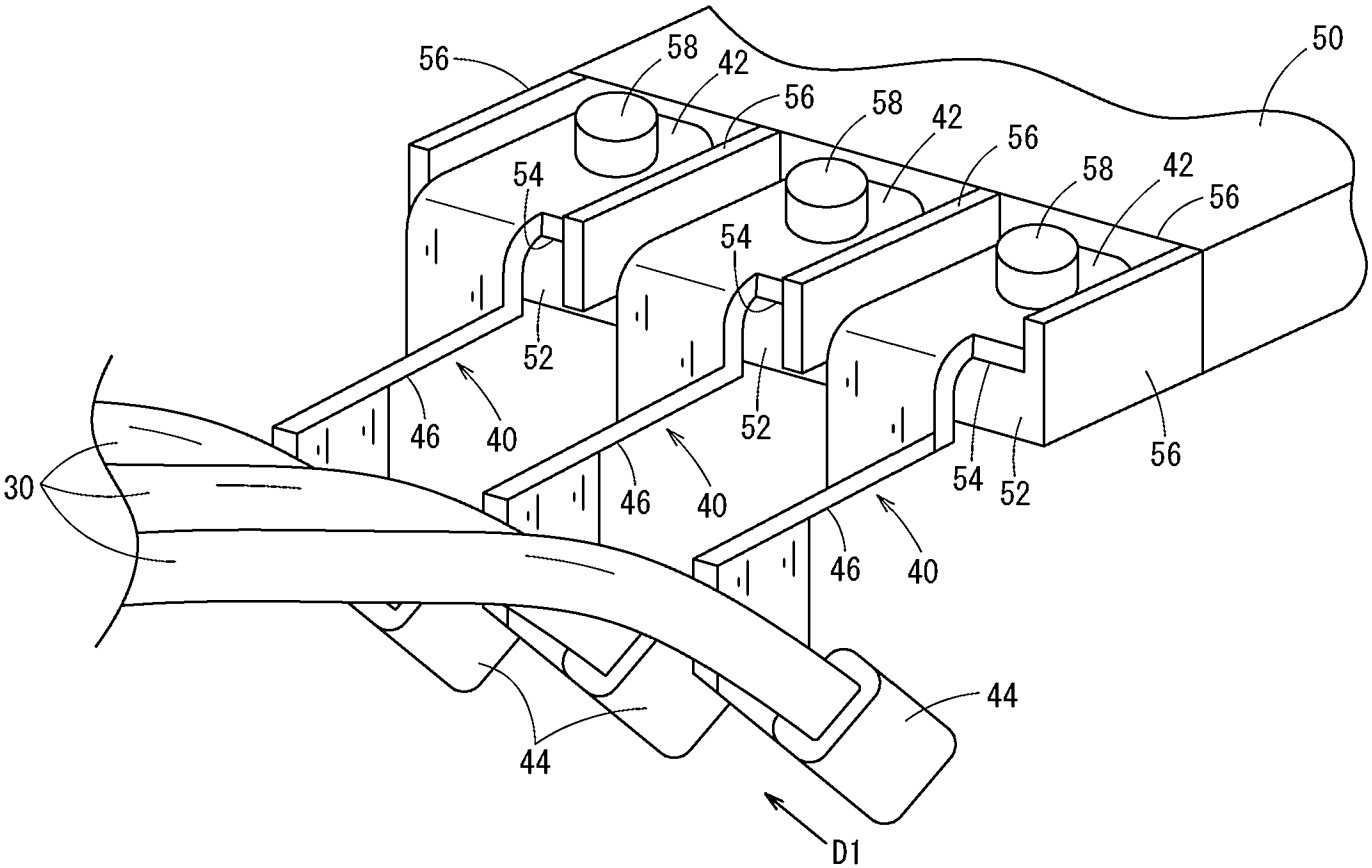
FIG. 5 is an external view of a busbar terminal connection structure in which the busbar terminals, one of which is illustrated in FIG. 3, connect conducting wires and a terminal base to each other.

The fastening portion 42 is flat as a whole and includes a bolt insertion hole 48, which extends through from a first flat surface 42*a* to a second flat surface 42*b*. The fastening portion 42 is the widest portion in the busbar terminal 40 and is fastened to the terminal base 50 (FIG. 5).

The crimping portion 44 is formed in the following manner. First, a second end portion of a flat metal member is bent so as to have a cylinder shape. At this time, an end portion of each conducting wire 30 (FIG. 5) covered with the insulating member is held inside the cylinder. Subsequently, as illustrated in FIG. 4, the cylindrical second end portion is heated and pressed by electrodes E1 and E2 (thermal crimping). Thus, the crimping portion 44 is formed and, concurrently, the crimping portion 44 and the conducting wire 30 are welded to one another. Subjected-to-crimping surfaces 44*a* and 44*b* are formed at pressed surfaces of the electrodes E1 and E2. During crimping, the electrodes E1 and E2 apply pressure to the cylindrical second end portion in a direction parallel to a normal P2, perpendicular to the subjected-to-crimping surfaces 44*a* and 44*b* of the crimping portion 44, such that a first parallel line P1', parallel to a normal P1 perpendicular to the flat surfaces 42*a* and 42*b* of the fastening portion 42, and the normal P2 are substantially perpendicular to each other. The axis A of the crimping portion 44 is inclined at a predetermined angle θ with respect to the flat surfaces 42*a* and 42*b* of the fastening portion 42. The angle θ falls within a range of 30° to 60°, preferably 40° to 50°, or more preferably, 44° to 46°. An inclination at such an angle θ allows the axis A of the crimping portion 44 to be inclined within a range of 30° to 60° or 60° to 30° with respect to the perpendicular direction regardless of whether the fastening portion 42 in the busbar terminal 40 is in the horizontal position or the vertical position. The angle θ can be determined by adjusting the flat shape of the metal member and the amount of bending at bent portions 46*a*, 46*b*, and 46*c* of the torsion portion 46, described below. The conducting wires 30 can extend from the torsion portion 46 in a first direction D1 and in a second direction D2, opposite to the first direction D1.

The torsion portion 46 is directly continuous with the fastening portion 42 and the crimping portion 44. The torsion portion 46 is formed as a result of a flat metal member being bent at multiple positions in a first or second direction. The torsion portion 46 of the busbar terminal 40 illustrated in FIG. 3 has three bent portions 46*a*, 46*b*, and 46*c*. The bent portions 46*a* and 46*c* are bent in the first direction and the bent portion 46*b* is bent in the second direction. The amount of bending and the direction of bending of the torsion portion 46 can be determined by adjusting the flat shape of the metal member and the amount of bending of the bent portions 46*a*, 46*b*, and 46*c*. The three bent portions 46*a*, 46*b*, and 46*c* have the function of dispersing and relaxing stress that occurs in the busbar terminal 40. The twisting shape of the torsion portion 46 enables size reduction of the busbar terminal 40. Although the torsion portion 46 illustrated in FIG. 3 has stepwise torsion (bent portions 46*a*, 46*b*, and 46*c*), the torsion portion 46 may have continuous torsion.

3. Busbar Terminal Connection Structure

Referring now to FIG. 2 and FIG. 5, the busbar terminal connection structure in which the terminal base 50 and the conducting wires 30 are electrically connected to each other by the busbar terminals 40 is described. The outer circumferential portion of the terminal base 50 is formed of an insulator such as resin. The terminal base 50 includes three fastening bases 52 corresponding to the three (U-phase, V-phase, and W-phase) conducting wires 30 extending from the alternating-current motor 10. The three fastening bases 52 are integrated with one another and extend to the vehicle rear. Each fastening base 52 has a substantially flat subjected-to-fastening surface 54. An external terminal of the PCU 20 is placed in each subjected-to-fastening surface 54 while partially left uncovered. In addition, each subjected-to-fastening surface 54 has a bolt hole (not illustrated). Each subjected-to-fastening surface 54 is surrounded by walls 56 from three sides, except for the side to which the busbar terminal 40 extends (to the vehicle rear). The walls 56 secure insulations between adjacent terminals.

The fastening portions 42 of the three busbar terminals 40 are fastened to the three subjected-to-fastening surfaces 54 of the terminal base 50 using fastening members such as bolts 58. Screws are also usable instead of the bolts 58. The fastening portions 42 fastened to the subjected-to-fastening surfaces 54 are parallel to the vehicle front-rear direction and the vehicle width direction. The three busbar terminals 40 are fastened to the terminal base 50 while having the same positions. Specifically, the three busbar terminals 40 extend in the same direction while being arranged side by side. In this state, the torsion portions 46 of the three busbar terminals 40 are disposed parallel to one another. In this configuration, the busbar terminals 40 are prevented from touching each other even when the terminal base 50 vibrates.

As described above, the conducting wires 30 of the alternating-current motor 10 are welded in advance to the crimping portions 44 of the busbar terminals 40 by thermal crimping. When the fastening portions 42 of the busbar terminals 40 are fastened to the subjected-to-fastening surfaces 54 of the terminal base 50, the conducting wires 30 and the terminals of the fastening bases 52 are electrically connected to one another by the busbar terminals 40. Thus, the alternating-current motor 10 and the electric circuit of the PCU 20 are electrically connected to one another.

As illustrated in FIG. 2 and FIG. 5, the conducting wires 30 are connected to the crimping portions 44 from the first direction D1. When the busbar terminals 40 are fastened to the terminal base 50, the first direction D1 mostly coincides with the direction in which the conducting wires 30 are wound. This is because, as illustrated in FIG. 4, the angle θ between the flat surfaces 42*a* and 42*b* (see FIG. 3) of the fastening portion 42 and the axis A of the crimping portion 44 is so determined as to fall within a range of 30° to 60°.

Each busbar terminal 40 may have any of various different forms. For example, the busbar terminal 40 may have, for example, the shape of a busbar terminal 60 or 70 illustrated in FIG. 6 or FIG. 7, instead of the shape of the busbar terminal 40.

Figure 6:
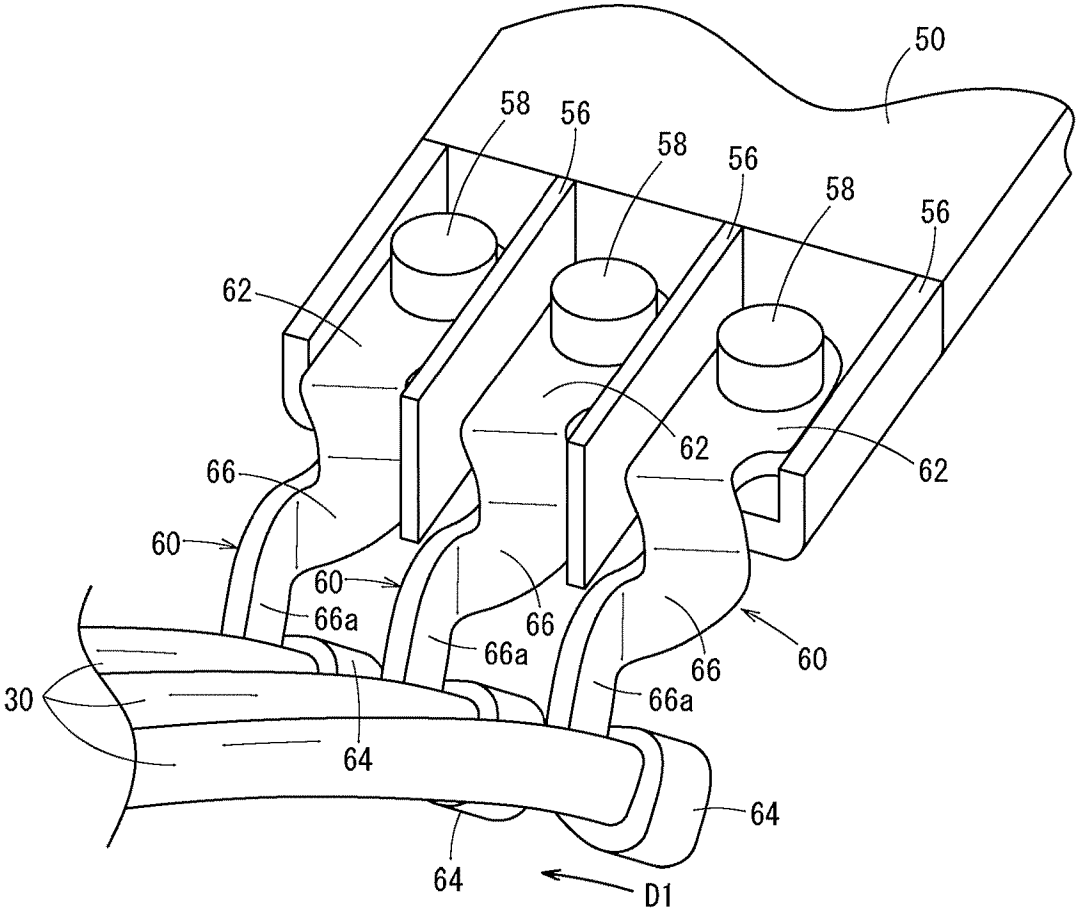
FIG. 6 is an external view of a busbar terminal connection structure in which busbar terminals different from the busbar terminal illustrated in FIG. 3 connect conducting wires and a terminal base to each other.

FIG. 6 illustrates a busbar terminal connection structure including busbar terminals 60, having a different configuration from the busbar terminals 40 illustrated in FIG. 3 to FIG. 5. The busbar terminals 60 illustrated in FIG. 6 each include a fastening portion 62, a crimping portion 64, and a torsion portion 66 between the fastening portion 62 and the crimping portion 64. The torsion portion 66 of each busbar terminal 60 is twisted in the direction opposite to the direction in which the torsion portion 46 of each busbar terminal 40, illustrated in FIG. 3 and other drawings, is twisted. In this manner, the direction of twisting of the torsion portion is not limited to a particular direction.

In the busbar terminal connection structure illustrated in FIG. 6, a portion of each torsion portion 66 located outward beyond the end of the terminal base 50, specifically, located toward the alternating-current motor 10 beyond the wall 56 is a flat board 66*a*, which is free from twisting. Each flat board 66*a* is inclined approximately 90° with respect to the fastening portion 62. Specifically, the normal perpendicular to the flat board 66*a* and the parallel line parallel to the normal perpendicular to the fastening portion 62 intersect at right angles. In this configuration, adjacent busbar terminals 60 are less likely to touch each other.

Figure 7:
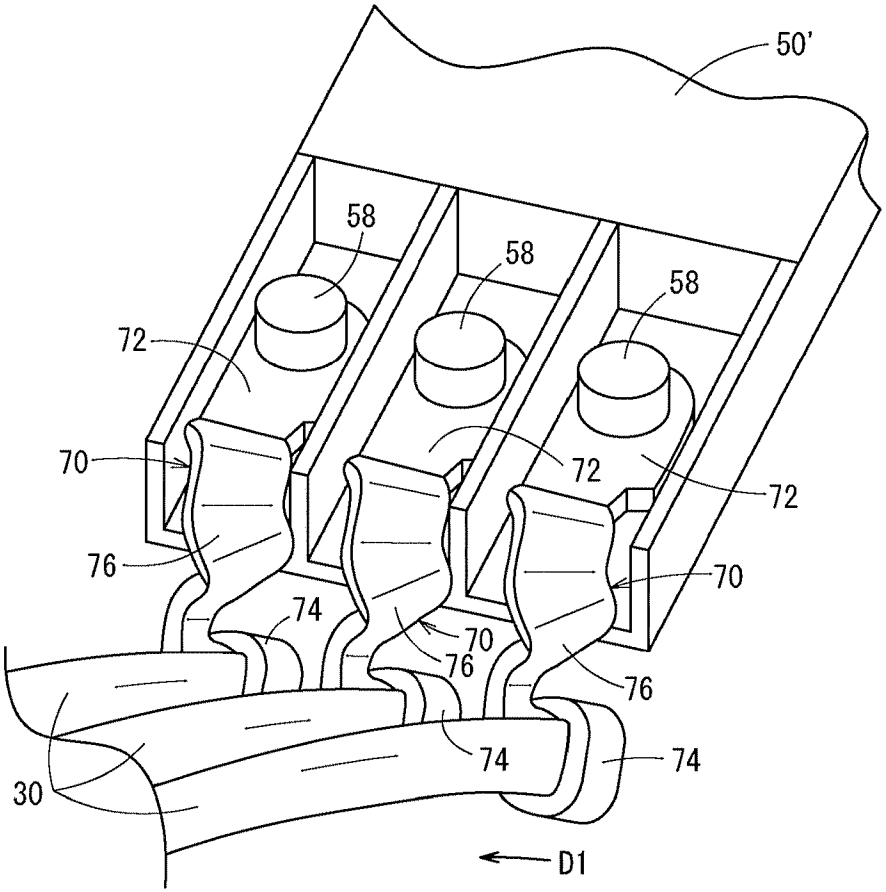
FIG. 7 is an external view of a busbar terminal connection structure in which busbar terminals different from the busbar terminal illustrated in FIG. 3 connect conducting wires and a terminal base to each other.

FIG. 7 illustrates a busbar terminal connection structure including busbar terminals 70, having a different configuration from the busbar terminals 40 illustrated in FIG. 3 to FIG. 5 and the busbar terminals 60 illustrated in FIG. 6. The busbar terminals 70 illustrated in FIG. 7 each include a fastening portion 72, a crimping portion 74, and a torsion portion 76 between the fastening portion 72 and the crimping portion 74. The torsion portion 76 of each busbar terminal 70 is longer and has more bent portions than the torsion portions 46 of the busbar terminals 40 illustrated in FIG. 3 and other drawings and the torsion portions 66 of the busbar terminals 60 illustrated in FIG. 6. The torsion portion 76 having more bent portions and larger length can secure a distance for insulation regardless of the length of the terminal base 50'.

4. Procedure of Connecting Alternating-Current Motor 10 and PCU 20

Now, the procedure of connecting the alternating-current motor 10 of a first type and the PCU 20 of a first type is described. First, the conducting wires 30 of the alternating-current motor 10 are connected to the crimping portions 44 of the busbar terminals 40 from the first direction D1 and the crimping portions 44 are subjected to thermal crimping. Subsequently, the busbar terminals 40 are disposed in a first orientation so as to correspond to the orientation in which the terminal base 50 is disposed. At this time, the fastening portions 42 of the busbar terminals 40 are disposed so as to be substantially parallel to the vehicle front-rear direction. Each fastening portion 42 of the busbar terminal 40 in the first orientation and the terminal base 50 are fastened to each other.

5. Arrangement 2 of Alternating-Current Motor 10 and PCU 20

Figure 8:
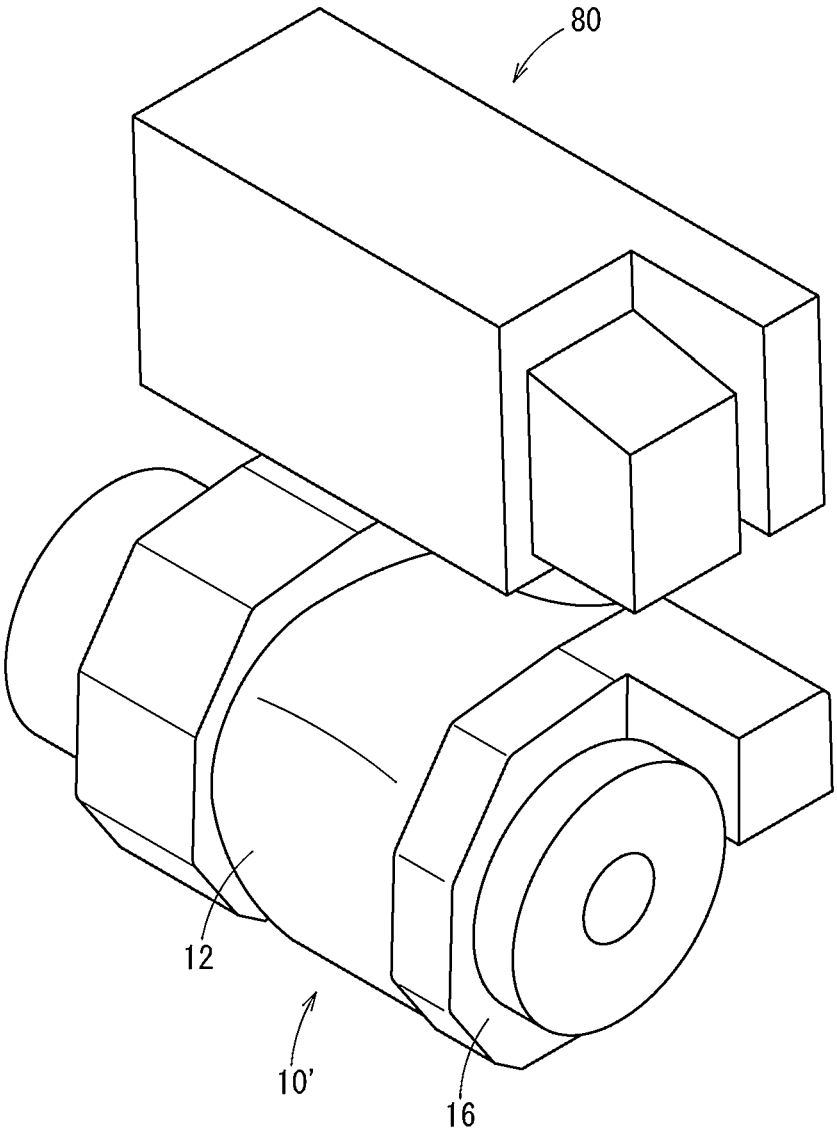
FIG. 8 is an external view of an alternating-current motor and a PCU.

FIG. 8 illustrates an example of an arrangement of an alternating-current motor 10' and a PCU 80. In an embodiment illustrated in FIG. 8, the PCU 80 is disposed to the vehicle upper side of the alternating-current motor 10'.

Figure 9:
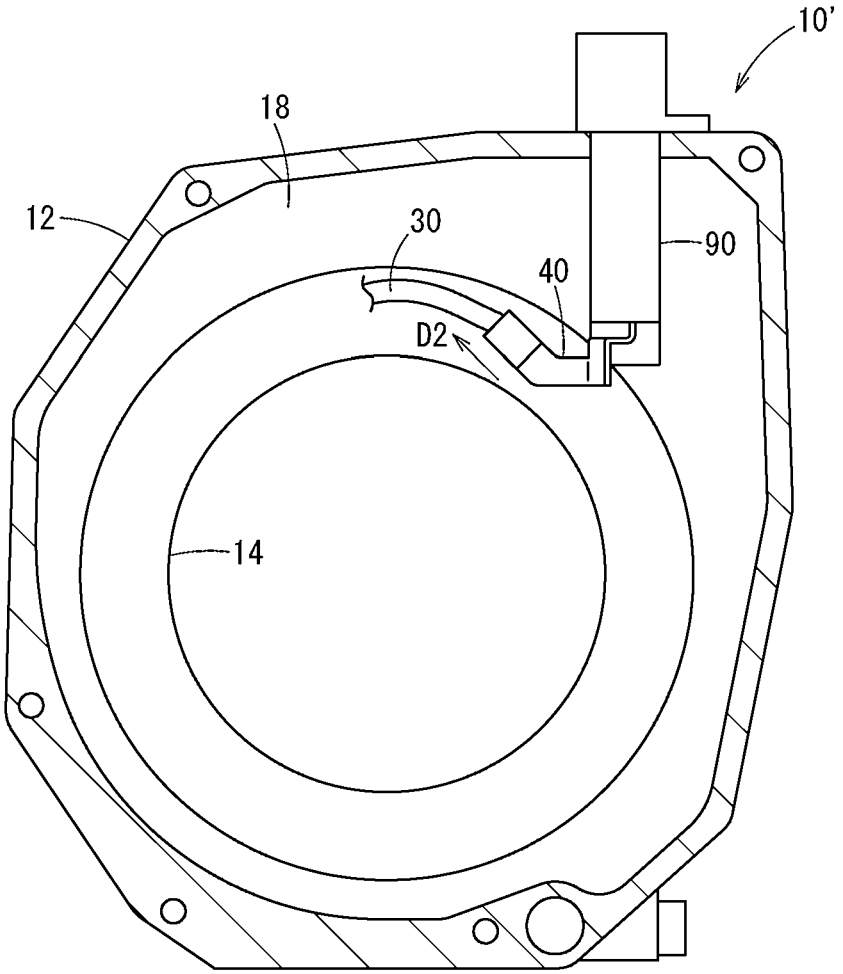
FIG. 9 illustrates an arrangement of a conducting wire and a terminal base.

FIG. 9 illustrates the alternating-current motor 10' from which a lid 16 (see FIG. 8) is removed and viewed in the axial direction, as in the case of FIG. 2. FIG. 9 illustrates the positions of the conducting wire 30 and a terminal base 90 in an arrangement example of FIG. 8. The up-down direction in FIG. 9 coincides with the vehicle up-down direction. As in the case of FIG. 2, the lead portion of each conducting wire 30 is wound and extends in a clockwise direction in FIG. 9. On the other hand, the terminal base 90 extends toward the vehicle lower side (downward in FIG. 9). The conducting wire 30 and terminal of the terminal base 90 are connected to one another with the busbar terminals 40 interposed therebetween. This configuration is the same as the configuration illustrated in FIG. 2 to FIG. 5.

Figure 10:
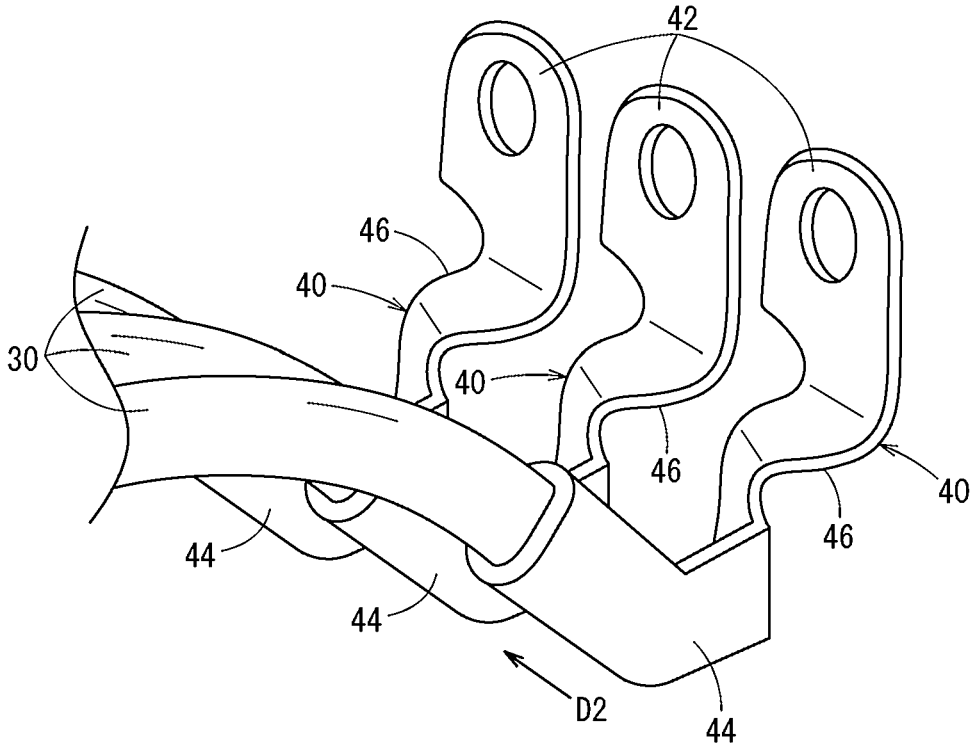
FIG. 10 is an external view of a busbar terminal connection structure in which the busbar terminals, one of which is illustrated in FIG. 3, connect conducting wires and a terminal base to each other.

FIG. 10 illustrates attachment positions of the busbar terminals 40 illustrated in FIG. 9. The up-down direction in FIG. 10 coincides with the vehicle up-down direction. The fastening portion 42 of each busbar terminal 40 illustrated in FIG. 2 to FIG. 5 is parallel to the vehicle front-rear direction and the vehicle width direction, whereas the fastening portion 42 of each busbar terminal 40 illustrated in FIG. 9 and FIG. 10 is parallel to the vehicle up-down direction. Specifically, the same busbar terminals 40 are used in a first vehicle, in which the PCU 20 is disposed in front of the alternating-current motor 10 as illustrated in FIG. 1, and in a second vehicle, in which the PCU 80 is disposed above the alternating-current motor 10' as illustrated in FIG. 8, whereas the orientations (attachment positions) of the busbar terminals 40 in different vehicles differ from each other. The busbar terminal 40 when disposed in the first vehicle is in the first orientation, whereas the busbar terminal 40 when disposed in the second vehicle is in the second orientation.

As illustrated in FIG. 9 and FIG. 10, the conducting wires 30 are connected to the crimping portions 44 from the second direction D2. When the busbar terminals 40 are fastened to the terminal base 90, the second direction D2 mostly coincides with the direction in which the conducting wires 30 are wound. This is because, as illustrated in FIG. 4, the angle θ between the flat surfaces 42*a* and 42*b* (see FIG.

3) of the fastening portion 42 and the axis A of the crimping portion 44 is determined so as to fall within a range of 30° to 60°.

6. Procedure of Connecting Alternating-Current Motor 10' and PCU 80

Referring to FIG. 8 to FIG. 10, the procedure of connecting the alternating-current motor of a second type 10' and the PCU 80 of a second type is described. First, the conducting wires 30 of the alternating-current motor 10' are connected to the crimping portions 44 of the busbar terminals 40 from the second direction D2 and the crimping portions 44 are subjected to thermal crimping. Subsequently, the busbar terminals 40 are disposed in a second orientation so as to correspond to the orientation in which the terminal base 90 is disposed. At this time, the fastening portions 42 of the busbar terminals 40 are disposed so as to be substantially parallel to the vehicle front-rear direction. Each fastening portion 42 of the busbar terminal 40 in the second orientation and the terminal base 90 are fastened to each other.

7. Outline

Referring to FIG. 2 to FIG. 5, FIG. 9, and FIG. 10, the busbar terminal 40 according to the embodiment includes a fastening portion 42, fastened to the terminal base 50 or 90, a crimping portion 44, connected to a conducting wire 30, and a torsion portion 46, interposed between the fastening portion 42 and the crimping portion 44 and extending from the fastening portion 42 to the crimping portion 44 while being twisted. Since the busbar terminal 40 includes the torsion portion 46 extending from the fastening portion 42 to the crimping portion 44 while being twisted, stress that occurs in the busbar terminal 40 is dispersed and relaxed throughout the torsion portion 46. Thus, the stress is prevented from being concentrated at a specific portion, whereby breakage of the busbar terminal 40 is avoidable.

In addition, the first parallel line P1', parallel to the normal P1 perpendicular to the flat surfaces 42*a* and 42*b* of the fastening portion 42, and the normal P2, perpendicular to the subjected-to-crimping surfaces 44*a* and 44*b* of the crimping portion 44, are substantially perpendicular to each other. In this configuration, when multiple busbar terminals 40 are arranged side by side, the busbar terminals 40 are allowed to be spaced apart from one another at large intervals (distance for insulation).

In addition, the axis A of the crimping portion 44 is inclined at approximately 30° to 60° with respect to the fastening portion 42. In this configuration, regardless of whether the fastening portion 42 is in the horizontal position as illustrated in FIG. 2 and FIG. 5 or in the vertical position as illustrated in FIG. 9 and FIG. 10, the crimping portion 44 is inclined at 30° to 60° with respect to the fastening portion 42. Thus, the same busbar terminals 40 are compatible with the two terminal bases 50 and 90 having different orientations that differ by 90°. Specifically, this configuration achieves cost reduction since the same components are usable in multiple layouts.

The three busbar terminals 40 are arranged side by side and extend in the same direction. This configuration enables size reduction of the terminal base 50 or 90. In addition, since each busbar terminal 40 includes the torsion portion 46, the busbar terminal 40 can secure a distance for insulation. Moreover, the torsion portions 46 of the three busbar terminals 40 are disposed parallel to one another. This configuration can increase the distance (distance for insulation) between the busbar terminals.

The busbar terminals 60 and 70 illustrated in FIG. 6 and FIG. 7 also have the same effects as the busbar terminals 40.

In this embodiment, the three-phase alternating-current motor 10 and 10' and the PCU 20 and 80 are assumed as electrical devices electrically connected to each other by the busbar terminal 40. However, the application is not limited to these devices. Any electrical devices are connectable to each other by the busbar terminal 40 as long as conducting wires extend from one of the electrical devices and the other one of the electrical devices includes a terminal base.

A busbar terminal of the present application is a busbar terminal that electrically connects a terminal base and a conducting wire and that includes a fastening portion fastened to the terminal base, a crimping portion connected to the conducting wire, and a torsion portion interposed between the fastening portion and the crimping portion and extending from the fastening portion to the crimping portion while being twisted. Since the busbar terminal includes the torsion portion extending from the fastening portion to the crimping portion while being twisted, stress that occurs in the busbar terminal is dispersed and relaxed throughout the torsion portion. Thus, the stress is prevented from being concentrated at a specific portion, whereby breakage of the busbar terminal avoidable.

In the busbar terminal, a line parallel to a normal perpendicular to a flat surface of the fastening portion may be substantially perpendicular to a normal perpendicular to a subjected-to-crimping surface of the crimping portion. In this configuration, when multiple busbar terminals are arranged side by side, the busbar terminals are allowed to be spaced apart from one another at large intervals (distance for insulation).

An axis of the crimping portion may be inclined at 30° to 60° with respect to the fastening portion. In this configuration, regardless of whether the fastening portion is in the horizontal position or in the vertical position, the crimping portion is inclined at 30° to 60° with respect to the fastening portion. Thus, the same busbar terminals are compatible with two layouts including terminal bases placed in different orientations with respect to the conducting wires, the orientations differing by 90°. This configuration achieves cost reduction since the same components are usable in multiple layouts.

A busbar terminal connection structure includes at least three busbar terminals to electrically connect the terminal base and the conducting wire to each other. The conducting wire extends from a coil of an alternating-current motor. The terminal base is attached to a power control unit that controls actuation and/or regeneration of the alternating-current motor and includes subjected-to-fastening surfaces to which the at least three busbar terminals are individually fastened. The at least three busbar terminals are arranged side by side and extend in the same direction. This configuration enables size reduction of the busbar terminal connection structure since the busbar terminals extend in the same direction. In addition, since each busbar terminal includes the torsion portion, the busbar terminal can secure a distance for insulation.

The torsion portions of the at least three busbar terminals may be parallel to one another. This configuration can increase the distance (distance for insulation) between the busbar terminals.

A busbar terminal connection method for electrically connecting a conducting wire of a first alternating-current motor and a terminal base of a first power control unit to each other using the busbar terminal and electrically connecting a conducting wire of a second alternating-current motor and a terminal base of a second power control unit to each other using the busbar terminal includes the following steps. The conducting wire of the first alternating-current motor and the conducting wire of the second alternating-current motor, the conducting wires extending in the same direction are prepared, and the terminal base of the first power control unit and the terminal base of the second power control unit, the terminal bases being attached in different directions are prepared. The first alternating-current motor and the first power control unit are connected to each other by connecting the conducting wire of the first alternating-current motor to the crimping portion of the busbar terminal from a first direction, crimping the crimping portion, placing the busbar terminal in a first orientation, and then fastening the busbar terminal and the terminal base of the first power control unit to each other. The second alternating-current motor and the second power control unit are connected to each other by connecting the conducting wire of the second alternating-current motor to the crimping portion of the busbar terminal from a second direction opposite to the first direction, crimping the crimping portion, placing the busbar terminal in a second orientation, and then fastening the busbar terminal and the terminal base of the second power control unit to each other. This method renders the same busbar terminals compatible with two layouts including terminal bases placed in different orientations with respect to the conducting wires, by changing the orientations of the busbar terminals. This method achieves cost reduction since the same components are usable in multiple layouts.

In this application, stress that occurs in a busbar terminal is dispersed and relaxed throughout a torsion portion. Thus, the stress is prevented from being concentrated at a specific portion, whereby breakage of the busbar terminal is avoidable.

Obviously, numerous modifications and variations of the present invention are possible in light of the above teachings. It is therefore to be understood that within the scope of the appended claims, the invention may be practiced otherwise than as specifically described herein.

What is claimed is:

1. A busbar terminal connection structure comprising:

a conducting wire extending from a motor; and a busbar terminal configured to electrically connect a terminal base and the conducting wire to each other, the busbar terminal comprising:

a fastening portion fastened to the terminal base;

a crimping portion connected to the conducting wire, the conducting wire having a portion configured to connect to the crimping portion along a direction that coincides with a circumferential direction of the motor; and a torsion portion interposed between the fastening portion and the crimping portion and extending from the fastening portion to the crimping portion while being twisted, wherein an axis of the crimping portion is inclined at 30° to 60° with respect to the fastening portion by a plurality of bends disposed in the torsion portion.

2. The busbar terminal connection structure according to claim 1, wherein a line parallel to a normal perpendicular to a flat surface of the fastening portion is substantially perpendicular to a normal perpendicular to a subjected-to-crimping surface of the crimping portion.

3. The busbar terminal connection structure according to claim 1, further comprising at least three busbar terminals including the busbar terminal, each corresponding to the busbar terminal, to electrically connect the terminal base and the conducting wire to each other, wherein the conducting wire extends from a coil of the motor, which is an alternating-current motor, wherein the terminal base is attached to a power control unit that controls actuation and/or regeneration of the alternating-current motor and the terminal base includes subjected-to-fastening surfaces to which the at least three busbar terminals are individually fastened, and wherein the at least three busbar terminals are arranged side by side and extend in the same direction.

4. The busbar terminal connection structure according to claim 3, wherein the torsion portions of the at least three busbar terminals are parallel to one another.

5. A busbar terminal connection method for electrically connecting a conducting wire of a first alternating-current motor and a terminal base of a first power control unit to each other using the busbar terminal connection structure according to claim 1, and electrically connecting a conducting wire of a second alternating-current motor and a terminal base of a second power control unit to each other using the busbar terminal connection structure according to claim 1, the conducting wires extending in the same direction, and the terminal bases being attached in different directions, the method comprising:

connecting the conducting wire of the first alternating-current motor to the crimping portion of the busbar terminal from a first direction, crimping the crimping portion, placing the busbar terminal in a first orientation, and then fastening the busbar terminal and the terminal base of the first power control unit to each other to connect the first alternating-current motor and the first power control unit to each other; and connecting the conducting wire of the second alternating-current motor to the crimping portion of the busbar terminal from a second direction opposite to the first direction, crimping the crimping portion, placing the busbar terminal in a second orientation, and then fastening the busbar terminal and the terminal base of the second power control unit to each other to connect the second alternating-current motor and the second power control unit to each other.

6. The busbar terminal connection structure according to claim 1, wherein the conducting wire is insertable along an axial direction aligned with the axis of the crimping portion into a first end of the crimping portion when the fastening portion is disposed in a first position, and the conducting wire is insertable along the axial direction into a second end of the crimping portion when the fastening portion is disposed in a second position that is different from the first position.

7. The busbar terminal connection structure according to claim 6, wherein the first end and the second end are spaced apart from each other along the axial direction, wherein the axis of the crimping portion extends from the first end and is inclined at 30° to 60° with respect to a vertical direction when the fastening portion is disposed in the first position, and wherein the axis of the crimping portion extends from the second end and is inclined at 30° to 60° with respect to the vertical direction when the fastening portion is disposed in the second position.

8. The busbar terminal connection structure according to claim 7, wherein the first position and the second position are offset from each other by 90°.

9. The busbar terminal connection structure according to claim 1, wherein the crimping portion is configured to connect to the portion of the conducting wire such that the portion of the conducting wire coincides with a direction in which conducting wires of the motor are wound.

10. The busbar terminal connection structure according to claim 1, further comprising a plurality of busbar terminals disposed adjacent to each other, each of the plurality of busbar terminals having a crimping portion configured to connect to a respective conducting wire such that the conducting wires are adjacent to each other along an axial direction of the motor.

11. A busbar terminal connection structure comprising:

a conducting wire extending from a motor; and a busbar terminal comprising:

a fastening portion configured to be electrically connected to a terminal base;

a crimping portion configured to be electrically connected to a conducting wire, the conducting wire having a portion configured to connect to the crimping portion along a direction that coincides with a circumferential direction of the motor; and a torsion portion electrically connecting the fastening portion and the crimping portion and including a twisted part between the fastening portion and the crimping portion, wherein an axis of the crimping portion is inclined at 30° to 60° with respect to the fastening portion by a plurality of bends disposed in the twisted part of the torsion portion.

12. The busbar terminal connection structure according to claim 11, wherein a line parallel to a normal perpendicular to a flat surface of the fastening portion is substantially perpendicular to a normal perpendicular to a subjected-to-crimping surface of the crimping portion.

13. The busbar terminal connection structure according to claim 11, further comprising at least three busbar terminals, each corresponding to the busbar terminal, to electrically connect the terminal base and the conducting wire to each other, wherein the conducting wire extends from a coil of the motor, which is an alternating-current motor, wherein the terminal base is attached to a power control unit that controls actuation and/or regeneration of the alternating-current motor and the terminal base includes subjected-to-fastening surfaces to which the at least three busbar terminals are individually fastened, and wherein the at least three busbar terminals are arranged side by side and extend in the same direction.

14. The busbar terminal connection structure according to claim 13, wherein the torsion portions of the at least three busbar terminals are parallel to one another.

15. A busbar terminal connection method for electrically connecting a first conducting wire of a first alternating-current motor and a first terminal base of a first power control unit to each other with the busbar terminal connection structure according to claim 11, and electrically connecting a second conducting wire of a second alternating-current motor and a second terminal base of a second power control unit to each other with the busbar terminal connection structure according to claim 11, the first conducting wire and the second conducting wire extending in the same direction, and the first terminal base and the second terminal base being attached in different directions, the busbar terminal connection method comprising:

connecting the first conducting wire of the first alternating-current motor to the crimping portion of the busbar terminal from a first direction, crimping the crimping portion, placing the busbar terminal in a first orientation, and then fastening the busbar terminal and the first terminal base of the first power control unit to each other to connect the first alternating-current motor and the first power control unit to each other; and connecting the second conducting wire of the second alternating-current motor to the crimping portion of the busbar terminal from a second direction opposite to the first direction, crimping the crimping portion, placing the busbar terminal in a second orientation, and then fastening the busbar terminal and the second terminal base of the second power control unit to each other to connect the second alternating-current motor and the second power control unit to each other.

16. The busbar terminal connection structure according to claim 11, wherein the crimping portion is configured to receive the conducting wire when the conducting wire is inserted along an axial direction aligned with the axis of the crimping portion into a first end of the crimping portion with the fastening portion is disposed in a first position, and the crimping portion is configured to receive the conducting wire when the conducting wire is inserted along the axial direction into a second end of the crimping portion with the fastening portion is disposed in a second position that is different from the first position.

17. The busbar terminal connection structure according to claim 16, wherein the first end and the second end are spaced apart from each other along the axial direction, wherein the axis of the crimping portion extends from the first end and is inclined at 30° to 60° with respect to a vertical direction when the fastening portion is disposed in the first position, and wherein the axis of the crimping portion extends from the second end and is inclined at 30° to 60° with respect to the vertical direction when the fastening portion is disposed in the second position.

18. The busbar terminal connection structure according to claim 17, wherein the first position and the second position are offset from each other by 90°.

19. The busbar terminal connection structure according to claim 11, wherein the crimping portion is configured to connect to the portion of the conducting wire such that the portion of the conducting wire coincides with a direction in which conducting wires of the motor are wound.

20. The busbar terminal connection structure according to claim 11, further comprising a plurality of busbar terminals disposed adjacent to each other, each of the plurality of busbar terminals having a crimping portion configured to connect to a respective conducting wire such that the conducting wires are adjacent to each other along an axial direction of the motor.

* * * * *